US009170046B2

(12) United States Patent
Jung et al.

(10) Patent No.: US 9,170,046 B2
(45) Date of Patent: Oct. 27, 2015

(54) REFRIGERATOR COMPRISING VACUUM SPACE

(75) Inventors: Wonyeong Jung, Gyeongnam (KR); Myungryul Lee, Gyeongnam (KR); Sung Jhee, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 39 days.

(21) Appl. No.: 13/241,742

(22) Filed: Sep. 23, 2011

(65) Prior Publication Data

US 2012/0104923 A1 May 3, 2012

(30) Foreign Application Priority Data

Oct. 28, 2010 (KR) ..... 10-2010-0105894

(51) Int. Cl.
*A47B 96/04* (2006.01)
*F25D 23/08* (2006.01)
*F25D 23/06* (2006.01)

(52) U.S. Cl.
CPC ..... *F25D 23/085* (2013.01); *F25D 23/066* (2013.01); *F25D 2201/14* (2013.01)

(58) Field of Classification Search
CPC ..... F25D 23/066; F25D 23/085; F17C 3/02
USPC ..... 312/401, 405, 406, 407, 400, 406.1, 312/406.2; 362/92; 62/440; 52/406.1, 52/406.2, 406.3, 788.1
See application file for complete search history.

(56) References Cited

U.S. PATENT DOCUMENTS 1,845,353 A 2/1932 Snell
2,708,774 A * 5/1955 Seelen ..... 428/34
2,989,156 A * 6/1961 Brooks et al. ..... 52/788.1
3,813,137 A * 5/1974 Fellwock et al. ..... 312/406.1
3,936,553 A * 2/1976 Rowe ..... 428/81
4,330,310 A * 5/1982 Tate et al. ..... 62/275
6,029,846 A 2/2000 Hirath
6,038,830 A 3/2000 Hirath et al.
6,217,140 B1 4/2001 Hirath (Continued)

FOREIGN PATENT DOCUMENTS

CN 85204157 U 7/1986
CN 2033487 U 3/1989

(Continued)

OTHER PUBLICATIONS

Chinese Office Action dated Sep. 16, 2013, for Application No. 201110332399.X, with English Translation, 13 pages.

(Continued)

*Primary Examiner* — Daniel J Troy
*Assistant Examiner* — Andres F Gallego
(74) *Attorney, Agent, or Firm* — Fish & Richardson P.C.

(57) ABSTRACT

The refrigerator includes a body having a storage space for storing a predetermined storage object, wherein the body includes an inner case having the storage space, an outer case having an inside surface spaced a predetermined gap from an inside surface of the inner case to house the inner case, a vacuum space provided between the inner case and the outer case enclosed to maintain a vacuum state for heat insulating between the inner case and the outer case, and a sealing unit for sealing a front of the vacuum space formed between a front of the inner case and a front of the outer case and reducing a heat transfer rate between the inner case and the outer case.

11 Claims, 8 Drawing Sheets

(56) References Cited

U.S. PATENT DOCUMENTS

| | | | | |
|---|---|---|---|---|
| 6,220,685 | B1 | 4/2001 | Hirath | |
| 6,393,798 | B1 | 5/2002 | Hirath | |
| 6,408,841 | B1 | 6/2002 | Hirath et al. | |
| 6,485,122 | B2 | 11/2002 | Wolf | |
| 6,725,624 | B2 * | 4/2004 | Hirath et al. | 52/800.11 |
| 2002/0041134 | A1 * | 4/2002 | Wolf et al. | 312/400 |
| 2002/0100250 | A1 | 8/2002 | Hirath | |

FOREIGN PATENT DOCUMENTS

| | | | |
|---|---|---|---|
| CN | 2226260 | Y | 5/1996 |
| CN | 1276055 | A | 12/2000 |
| CN | 1587874 | A | 3/2005 |
| DE | 19745825 | A1 | 4/1999 |
| DE | 19745859 | A1 | 4/1999 |
| DE | 19745861 | A1 | 4/1999 |
| DE | 29912917 | U1 | 12/1999 |
| DE | 19907182 | A1 | 8/2000 |
| JP | H 07-234067 | A | 9/1995 |
| JP | 11-500074 | A | 1/1999 |
| JP | 2001-520363 | A | 10/2001 |
| KR | 20-1997-0024900 | A | 6/1997 |
| KR | 20-2000-0013045 | A | 7/2000 |

OTHER PUBLICATIONS

European Search Report dated Jan. 8, 2014, for Application No. 11008032.2, 8 pages.

Korean Notice of Allowance dated Aug. 3, 2015 for Korean Application. No. 10-2012-0145365, with English Translation, 3 pages.

* cited by examiner

REFRIGERATOR COMPRISING VACUUM SPACE

CROSS REFERENCE TO RELATED APPLICATION

This application claims the benefit of the Patent Korean Application No. 10-2010-0105894 filed on Oct. 28, 2010, which is hereby incorporated by reference as if fully set forth herein.

BACKGROUND OF THE DISCLOSURE

1. Field of the Disclosure

This invention relates to refrigerators, and more particularly to a refrigerator in which a vacuum space is formed between an outer case and an inner case of a body thereof for enhancing a heat insulating function.

2. Discussion of the Related Art

The refrigerator is a domestic appliance which forms a storage chamber temperature below zero or above zero degree for refrigerated or frozen storage of a storage object.

In general, the refrigerator is provided with the body having the storage space formed therein for storage of the storage object, and a door rotatably or slidably mounted to the body for opening/closing the storage space.

The body has the inner case to form the storage space, the outer case which houses the inner case, and an insulating material arranged between the inner case and the outer case.

The insulating material suppresses an external temperature from influencing the temperature of the storage space.

However, in order to produce an insulating effect by using the insulating material, it is required to secure a certain extent of thickness of the insulating material, implying that the insulating material becomes thicker as much, leading to have a thick wall between the inner case and the outer case, making the refrigerator bigger as much.

In the meantime, a recent trend of making the refrigerator compact calls for a requirement for making a volume of the storage space bigger while making an outside size smaller than before.

SUMMARY OF THE DISCLOSURE

Accordingly, this invention is directed to a refrigerator.

An object of this invention is to provide a refrigerator in which a vacuum space is formed between an outer case and an inner case for enhancing a heat insulating function and making an outside volume thereof compact.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator includes a body having a storage space for storing a predetermined storage object, wherein the body includes an inner case having the storage space, an outer case having an inside surface spaced a predetermined gap from an outside surface of the inner case to house the inner case, a vacuum space provided between the inner case and the outer case sealed to maintain a vacuum state for heat insulating between the inner case and the outer case, and a sealing unit for sealing a front of the vacuum space formed between a front of the inner case and a front of the outer case and reducing a heat transfer rate between the inner case and the outer case.

The sealing unit includes a blocking member arranged in front of the vacuum space connected between a front edge of the inner case and a front edge of the outer case to block the front of the vacuum space, and a filling member of an insulating material provided in front of the blocking member.

The sealing unit further includes a reinforcing member arranged in front of the filling member for reinforcing strength of the sealing unit.

The blocking member includes a first coupling portion provided to one side thereof coupled to and supported on the front edge of the inner case, a second coupling portion provided to the other side thereof coupled to and supported on the front edge of the outer case, and a projection provided between the first coupling portion and the second coupling portion projected toward the vacuum space for distributing a pressure caused by a pressure gradient formed between the vacuum space and an outside space.

The projection has an arch shaped cross section with a fixed thickness.

The sealing unit further includes a recess having a predetermined curved surface arranged in front of the blocking member opposite to the projection, with the filling member and the reinforcing member arranged in the recess.

The blocking member further includes a first coupling groove in the first coupling portion to couple to the front edge of the inner case, and a second coupling groove in the second coupling portion to couple to the front edge of the outer case.

The blocking member includes a first coupling portion provided to one side thereof coupled to and supported on the front edge of the inner case, a second coupling portion provided to the other side thereof coupled to and supported on the front edge of the outer case, and a recess provided in rear of the blocking member opposite to the vacuum space between the first coupling portion and the second coupling portion for distributing a pressure caused by a pressure gradient formed between the vacuum space and an outside space.

The recess has an arch shaped cross section with a fixed thickness.

The refrigerator further includes a projection provided in front of the blocking member bent toward a front side.

The filling member is arranged to surround the projection, and the reinforcing member is arranged to surround the filling member.

The first coupling portion is welded to the inner case, and the second coupling portion is welded to the outer case.

In another aspect of the this invention, a refrigerator includes a body having a storage space for storing a predetermined storage object, a wall which forms the body, a vacuum space formed in the wall sealed to maintain a vacuum state for heat insulating between an outside of the body and the storage space, and a sealing unit arranged in front of the wall to seal a front of the vacuum space.

The sealing unit further includes a blocking member arranged in front of the vacuum space connected to front edges of the body for blocking the front of the vacuum space, and a filling member of an insulating material in front of the blocking member.

The sealing unit further includes a reinforcing member arranged in front of the filling member for reinforcing strength of the sealing unit.

The blocking member includes a first coupling portion coupled to and supported on an inside front edge of the wall, a second coupling portion coupled to and supported on an outside front edge of the wall, and a projection provided between the first coupling portion and the second coupling portion projected backward toward the vacuum space for distributing a pressure caused by a pressure gradient formed between the vacuum space and an outside space, wherein the projection has an arch shaped cross section with a fixed thickness.

The blocking member includes a first coupling portion coupled to and supported on an inside front edge of the wall, a second coupling portion coupled to and supported on an outside front edge of the wall, and a recess provided opposite to the vacuum space in rear of the blocking member between the first coupling portion and the second coupling portion for distributing a pressure caused by a pressure gradient formed between the vacuum space and an outside space, wherein the recess has an arch shaped cross section with a fixed thickness.

It is to be understood that both the foregoing general description and the following detailed description of this invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of this invention, examples of which are illustrated in the accompanying drawings. Wherever possible, the same reference numbers will be used throughout the drawings to refer to the same or like parts.

Figure 1:
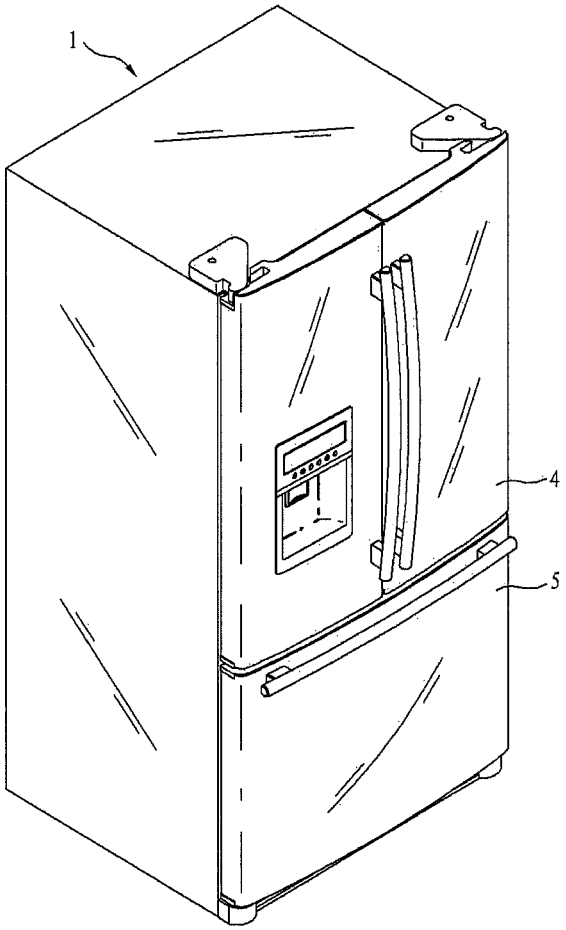
FIG. 1 illustrates a perspective view of a refrigerator in accordance with a preferred embodiment of this invention.

Referring to FIG. 1, the refrigerator includes a body 1 having a storage chamber formed therein, a first door 4 rotatably provided to the body 1, and a second door 5 slidably provided to the body 1.

In this instance, the first door 4 has a function of, but not limited to, opening/closing a refrigerating chamber in the storage chamber, and the second door 5 has a function of, but not limited to, opening/closing a freezing chamber in the storage chamber.

Figure 2:
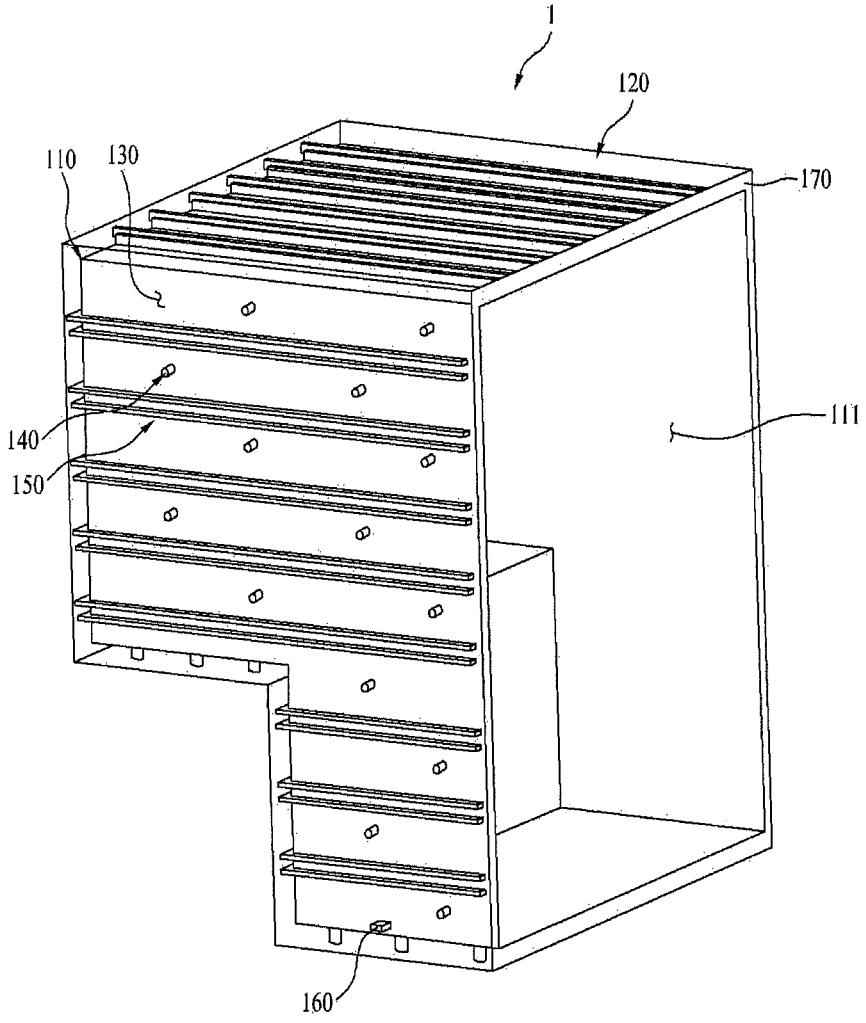
FIG. 2 illustrates a perspective view of a body of the refrigerator in accordance with a preferred embodiment of this invention, with an outer case thereof removed from a top side and a side thereof.

FIG. 2 illustrates a perspective view of a body of the refrigerator in accordance with a preferred embodiment of this invention, with an outer case thereof removed from a top side and a side thereof.

The body 1 has a structure including an inner case 110 which forms a predetermined storage space 111 therein, and an outer case 120 which forms a space for housing the inner case 110 therein and surrounds the inner case 110. The inner case 110 and the outer case 120 function as a wall which forms an exterior of the body 1 and the storage space 111 therein.

The outer case 120 and the inner case 110 are spaced from each other to form a space which has no additional insulating material arranged therein, but only a vacuum maintained therein for heat insulation.

That is, the vacuum space 130 formed between the outer case 120 and the inner case 110 maintains a state in which a medium which transmits heat between the inner case 110 and the outer case 120 is removed therefrom.

Therefore, the influence of warm air on an outside of the outer case 120 to a temperature of the inner case 110 may be prevented. This implies formation of the vacuum space 130 in the wall of the body 1 with the outer case 120 and the inner case 110, and by means of this, a heat insulating action may be made to take place between the outside of the body 1 and the storage space 111.

In order to make the vacuum space 130 between the inner case 110 and the outer case 120 to maintain a shape thereof, a supporting portion 140 is required, which serves as a spacer that maintains a gap between the inner case 110 and the outer case 120. The supporting portion 140 is arranged to be in contact with an outside surface of the inner case 110 and an inside surface of the outer case 120.

The supporting portion 140 may be provided such that the supporting portion 140 is arranged projected from the outside surface of the inner case 110 to make a surface to surface contact with the inside surface of the outer case 120, or is arranged projected from the inside surface of the outer case 120 to make a surface to surface contact with the outside surface of the inner case 110.

Or, the supporting portion 140 may be arranged both at the inside surface of the outer case 120 and at the outside surface of the inner case 110.

In this case, it is preferable that positions of the supporting portion 140 arranged at the inside surface of the outer case 120 and the positions of the supporting portion 140 arranged at the outside surface of the inner case 110 are, not overlap, but alternate, with one another.

In the meantime, reinforcing ribs 150 may be provided to the outside surface of the inner case 110 and the inside surface of the outer case 120 for reinforcing strength thereof, additionally.

Since thicknesses of the inner case 110 and the outer case 120 are not thick, the inner case 110 and the outer case 120 are liable to distort by an external impact, or deform at the time of evacuation to form the vacuum space 130.

Accordingly, the reinforcing ribs 150 are arranged on an outside surface of the inner case 110 or the inside surface of the outer case 120 for reinforcing the strength.

In this instance, it is preferable that the reinforcing ribs 150 are plural, and arranged spaced from one another on the outside surface of the inner case 110 or on the inside surface of the outer case 120.

In the meantime, a getter 160 is provided to the vacuum space 130 for collecting gas liable to present in the vacuum space 130, thereby preventing heat transfer caused by the gas liable to form by a chemical reaction of the outer case 120 or the inner case 110, in advance.

It is preferable that the getter 160 is provided to a ceiling or a bottom of the vacuum space 130.

The getter 160 has a substance which has a strong action of adsorbing residual gas molecules from the vacuum space 130 or making a chemical reaction therewith to form a solid compound.

Since it is difficult to obtain an adequate vacuum in the vacuum space 130 only with a vacuum pump technically, and it also costs high, the getter 160 is used.

There are different kinds of getters 160. If the getter 160 has a strong adsorbing action, the getter 160 is called as a flashed getter, and if the getter 160 is in a gaseous state with a strong chemical reaction, the getter 160 is called as a non-evaporable getter.

Presently, the getter 160 is formed of active charcoal, barium, magnesium, zirconium, red phosphorus, and so on.

In the meantime, the vacuum space 130 has a front covered with a front cover 170 which connects and seals front edges of the inner case 110 and the outer case 120.

Figure 3:
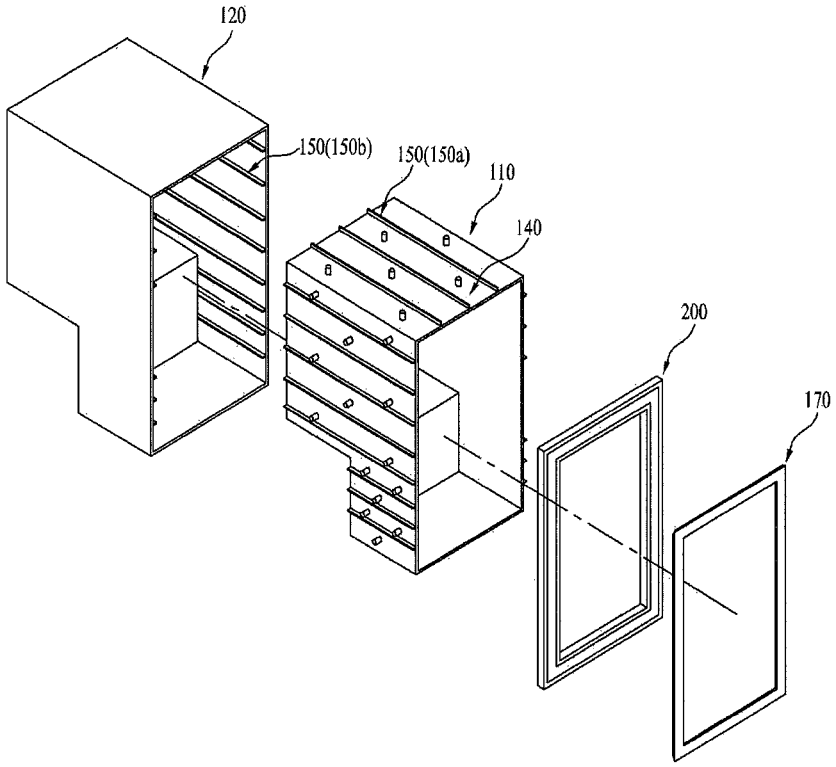
FIG. 3 illustrates an exploded perspective view of a body of the refrigerator in accordance with a preferred embodiment of this invention.

Referring to FIG. 3, the reinforcing ribs 150 and the supporting portions 140 are arranged spaced from each other not to overlap with each other. FIG. 3 illustrates the inner case 110 and the outer case 120.

Though it is shown that the reinforcing ribs 150 are arranged in one direction (A front to rear direction) on the outside surface of the inner case 110 and the inside surface of the outer case 120, the reinforcing ribs 150 may be arranged in many directions to cross with one another.

In the meantime, it may be possible to reinforce the inner case 110 and the outer case 120, not by the reinforcing ribs 150, but by forming portions each of which is a bent portion of the inner case 110 or the outer case 120.

It is preferable that the supporting portion 140 is arranged on a surface between the reinforcing ribs 150.

In this instance, if the reinforcing ribs 150 arranged on the inside surface of the outer case 120 are called as outside reinforcing ribs 150*a*, and the reinforcing ribs 150 arranged on the outside surface of the inner case 110 are called as inside reinforcing ribs 150*b*, it is required that the outside reinforcing ribs 150*a* and the inside reinforcing ribs 150*b* are spaced not overlap with each other not to interfere with each other.

Since, if overlap, or interfere with each other, a thickness of the vacuum space 130 becomes thicker, in order to minimize the thickness of the vacuum space 130, the overlap or interference between the inside reinforcing ribs 150*b* and the outside reinforcing ribs 150*a* are prevented.

Accordingly, it is preferable that the inside reinforcing ribs 150*b* and the outside reinforcing ribs 150*a* are arranged alternately in the vacuum space 130.

That is, it is preferable that, at a particular region of the vacuum space 130, the reinforcing ribs 150 are arranged in an order of the inside reinforcing ribs 150*b*—the outside reinforcing ribs 150*a*—the inside reinforcing ribs 150*b*—the outside reinforcing ribs 150*a*.

In the meantime, there is a sealing unit 200 provided between the front edges of the inner case 110 and the outer case 120 for sealing a front of the vacuum space 130, and the front cover 170 is arranged in front of the sealing unit 200 for preventing the sealing unit 200 from exposing to an outside of the refrigerator.

Figure 4:
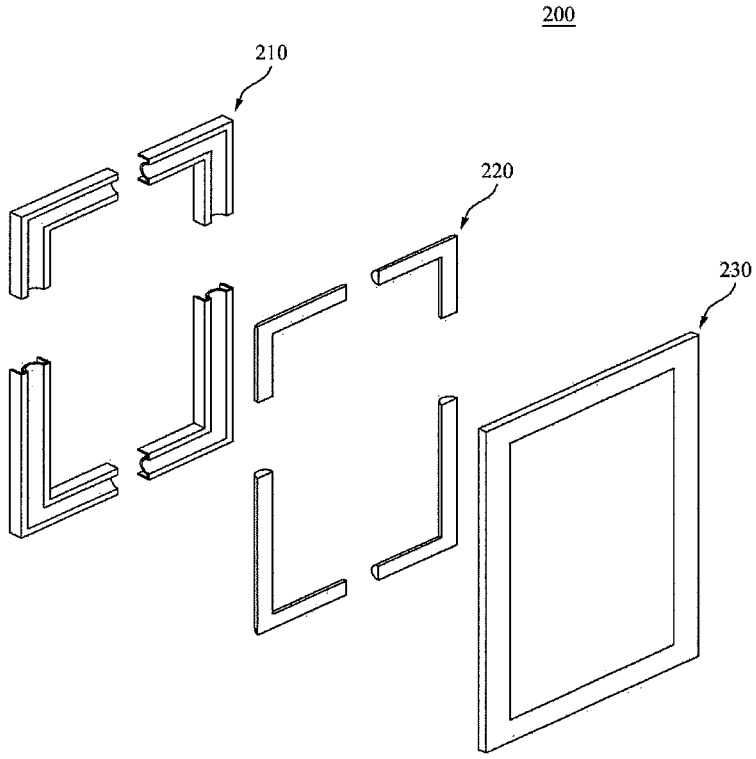
FIG. 4 illustrates an exploded perspective view of a sealing unit in accordance with a preferred embodiment of this invention.

FIG. 4 illustrates an exploded perspective view of a sealing unit in accordance with a preferred embodiment of this invention.

The sealing unit 200 includes a blocking member 210 arranged in front of the vacuum space connected or coupled to the front edge of the inner case 110 (Or, an inside front edge of the wall) and the front edge of the outer case 120 (Or, the outside front edge of the wall) for blocking the front of the vacuum space 130, a filling member 220 of an insulating material placed in a recess in a front of the blocking member 210, and a reinforcing member 230 arranged in front of the filling member 220 for reinforcing strength of the sealing unit 200.

Referring to FIG. 4, the blocking member 210 and the filling member 220 are shown cut off in middle thereof for showing cross sections thereof respectively. In general, it is preferable that the blocking member 210 and the filling member 220 are arranged to the vacuum space 130 in continuous states, respectively.

Figure 5:
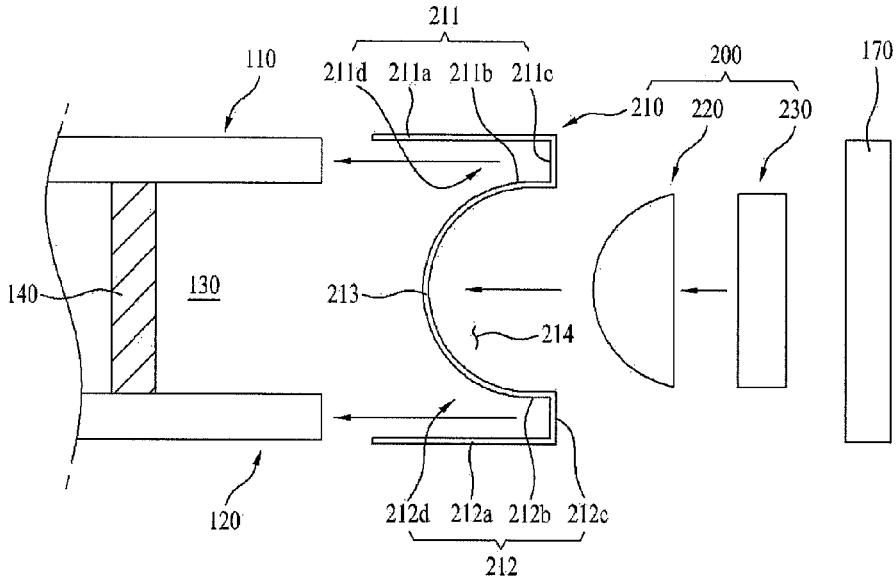
FIG. 5 illustrates an exploded cross sectional view of a sealing unit in accordance with a first preferred embodiment of this invention.

Referring to FIG. 5, the inner case 110 and the outer case 120 are arranged spaced from each other, between which a predetermined space is formed. That is, the wall is a double wall type spaced from each other between which the space is formed. After the space is sealed, the space becomes the vacuum space 130 by evacuation of air therefrom.

In a state the inner case 110 and the outer case 120 arranged spaced from each other, the blocking member 210 is mounted to the front edges of the inner case 110 and the outer case 120.

In order to mount the blocking member 210 to the inner case 110 and the outer case 120 easily, the blocking member 210 includes a first coupling portion 211 coupled to and supported on the front edge of the inner case 110 (the inside front edge of the wall) and a second coupling portion 212 coupled to and supported on the front edge of the outer case 120 (the outside front edge of the wall).

Each of the first coupling portion 211 and the second coupling portion 212 has a "⊂" shape and is placed in the front edge of the inner case 110 or the outer case 120.

The first coupling portion 211 includes an inside contact surface 211*b* in contact with an inside surface of the front edge of the inner case 110 (The inside front edge of the wall), and an outside contact surface 211*a* in contact with an outside surface of the front edge of the inner case 110, and a front contact surface 211*c* between the inside contact surface 211*b* and the outside contact surface 211*a* to be in contact with a front end of the inner case 110.

And, there is a first coupling groove 211*d* formed surrounded by the inside contact surface 211*b*, the outside contact surface 211*a*, and the front contact surface 211*c*, to place the front edge of the inner case 110 therein to couple thereto.

The second coupling portion 212 includes an outside contact surface 212*a* in contact with an outside surface of the front edge of the outer case 120 (The outside front edge of the wall), and an inside contact surface 212*b* in contact with an inside surface of the front edge of the outer case 120, and a front contact surface 212*c* between the outside contact surface 212*a* and the inside contact surface 212*b* to be in contact with a front end of the outer case 120.

And, there is a second coupling groove 212*d* formed surrounded by the outside contact surface 212*a*, the inside contact surface 212*b*, and the front contact surface 212*c*, to place the front edge of the outer case 120 therein to couple thereto.

It is preferable that the first coupling portion 211 and the second coupling portion 212 are coupled to the inner case 110 and the outer case 120 respectively with welding. This is required for sealing to form the vacuum.

In the meantime, there is a projection 213 toward the vacuum space 130 between the first coupling portion 211 and the second coupling portion 212. It is preferable that the projection 213 has a shape of an arch for distributing a pressure caused by a pressure gradient formed between the vacuum space 130 and an outside space.

That is, due to a pressure difference between the outside space and the vacuum space 130, the pressure is applied from the outside space to the vacuum space 130. If a space between the first coupling portion 211 and the second coupling portion 212 is flat, since it is liable to cause the pressure concentrated on a particular portion of the space, the projection 213 is formed to have the arch shape for uniform distribution of the pressure.

It is preferable that the projection 213 has a fixed thickness for the uniform distribution of the pressure.

It is preferable that the blocking member 210, the inner case 110, and the outer case 120 are formed of metal for enabling welding, and particularly, it is preferable that the blocking member 210 has a thin film shape for making a sealing function and minimizing heat transfer therethrough.

In this instance, it is preferable that the blocking member 210 has a thickness in a range of about 0.01~0.1 mm.

In the meantime, there is a recess 214 formed in an opposite direction of the projection, i.e., in front of the blocking member 210, for placing the filling member 220 and the reinforcing member 230 therein.

It is preferable that the filling member 220 has a curved surface in conformity with a cross section of the recess 214, and the reinforcing member 230 is arranged in front of the filling member 220 for securing a position of the filling member 220 and reinforcing an entire strength of the sealing unit 200.

And, there is a front cover 170 in front of the sealing unit 200 for covering above elements.

Figure 6:
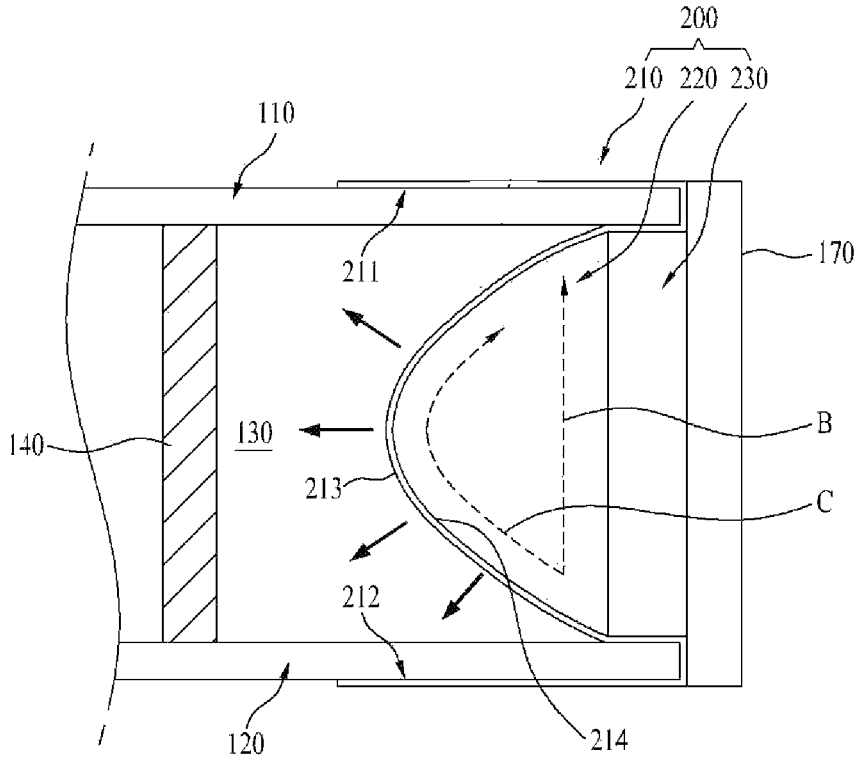
FIG. 6 illustrates a cross sectional view of an assembled sealing unit in accordance with a first preferred embodiment of this invention.

Referring to FIG. 6, after sealing the space between the inner case 110 and the outer case 120 with the inner case 110, the outer case 120, and the sealing unit 200, if the space is evacuated, the vacuum space 130 is formed.

In this state, the pressure is applied from the sealing unit 200 toward the vacuum space 130 by a pressure difference between the atmospheric pressure and the vacuum space 130.

However, the arch shaped projection of the blocking member 210 does not concentrate the pressure on a particular portion, but distribute throughout the arch shaped projection, to have a reliable structural characteristic.

If the pressure is concentrated on the particular portion, the portion is liable to break to release the vacuum state.

In the meantime, even if there is a pressure applied from the inner case 110 to the vacuum space 130, or from the outer case 120 to the vacuum space 130, the supporting portion 140 between the inner case 110 and the outer case 120 may maintain the shape of the vacuum space 130.

If there is a significant temperature difference between the inside of the inner case 110 and the outside of the outer case 120, i.e., if the inside of the inner case 110 is at a refrigerating temperature of 1° C.~6° C. or a freezing temperature of −20° C.~−25° C., and an outside temperature is at a room temperature, with significant temperature gradient, active heat transfer is likely to take place.

Overall heat transfer between the inner case 110 and the outer case 120 is cut off and suppressed by the vacuum space 130.

However, since there is the sealing unit 200 connected between the fronts of the inner case 110 and the outer case 120 for sealing the front of the vacuum space 130, a low flow rate of heat is transferred therethrough.

Since the filling member 220 causes the heat transfer to be made, not in a straight locus like a B direction, but in a curved locus like a C direction along the projection 213, a heat transfer path becomes longer than a case of a straight path.

If the heat transfer path becomes longer thus, to cause heat loss in middle of the heat transfer, the heat transfer is minimized and suppressed as much, enabling to prevent external heat of the outer case 120 from influencing toward the inner case 110.

The filling member 220 and the reinforcing member 230 which have heat insulating function are provided in the recess 214, and the front cover 170 is positioned in front of the reinforcing member 230, to prevent the filling member 220 and the reinforcing member 230 from exposing to an outside.

Figure 7:
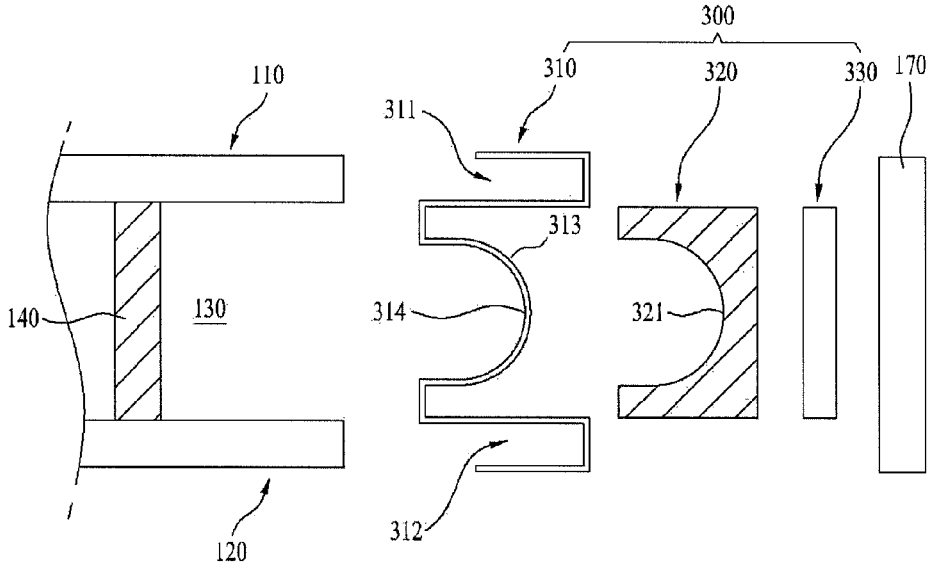
FIG. 7 illustrates an exploded cross sectional view of a sealing unit in accordance with a second preferred embodiment of this invention.

FIG. 7 illustrates an exploded cross sectional view of a sealing unit in accordance with a second preferred embodiment of this invention.

Referring to FIG. 7, the second embodiment discloses a sealing unit 300 arranged on front edges (A front edge of the wall) of the inner case 110 and the outer case 120 for sealing the vacuum space 130 formed therebetween. The sealing unit 300 is different from the sealing unit 200 disclosed in the first embodiment in view of configuration.

Alike the sealing unit 200 in the first embodiment, the sealing unit 300 also includes a blocking member 310 for blocking a front of the vacuum space 130, a filling member 320 arranged in front of the blocking member 310 for performing an insulating function, and a reinforcing member 330 for covering and reinforcing strength of the filling member 320.

And, there is a front cover 370 in front of the reinforcing member 330 for covering the inner case 110 and the outer case 120 to cover the filling member 320 and the reinforcing member 330.

The blocking member 310 includes a first coupling portion 311 to be welded and coupled to a front or a front edge (An inside front edge of the wall), and a second coupling portion 312 to be welded and coupled to a front or a front edge (An outside front edge of the wall) of the outer case 120.

And, there is a curved recess 314 arranged and connected between the first coupling unit 311 and the second coupling unit 312.

And, in an opposite direction of the recess 314, there is a projection 313 projected forward.

Alike the function of the projection 213 in the first embodiment, the recess 314 serves to distribute a pressure caused by a pressure gradient formed between the vacuum space 130 and an outside space, and, to do this, has a curved surface, more specifically, an arch shape.

The first coupling portion 311 has a ⊂ shaped bent coupled to the front of the inner case 110, and the second coupling portion 312 has a ⊂ shaped bent coupled to the front of the outer case 120 in a surface to surface fashion.

The filling member 320 is coupled to the blocking member 310 at a front thereof for performing heat insulation. The filling member 320 has a curved receiving portion 321 for receiving the projection 313 therein to make the coupling between the filling member 320 and the blocking member 310.

The reinforcing member 330 is provided to a front of the filling member 320 for reinforcing strength of the filling member 320 to protect the filling member 320 from external impact.

The front cover 170 arranged in front of the reinforcing member 330 surrounds the filling member 320 and the reinforcing member 330 to cover the same.

It is preferable that the front cover 170 has an outside appearance the same or similar to the inner case 110 and the outer case 120 in view of material or exterior so that the front cover 170 appears as one unit with the inner case 110 and the outer case 120 when the front cover 170 is seen from an outside of the refrigerator.

Figure 8:
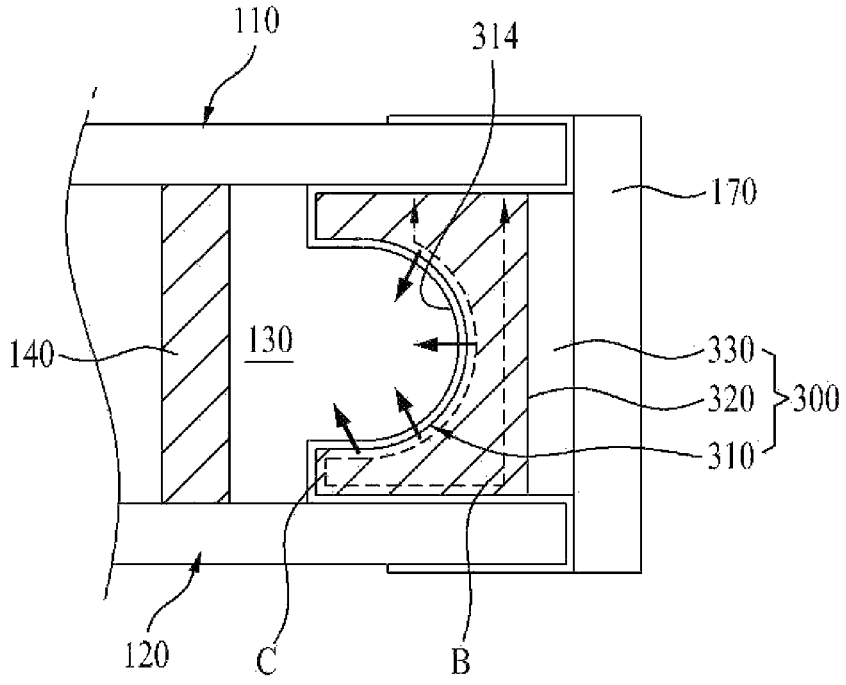
FIG. 8 illustrates a cross sectional view of an assembled sealing unit in accordance with a second preferred embodiment of this invention.

Referring to FIG. 8, after sealing the space between the inner case 110 and the outer case 120 with the inner case 110, the outer case 120, and the sealing unit 300, if the space is evacuated, the vacuum space 130 is formed.

In this state, the pressure is applied from the sealing unit 300 toward the vacuum space 130 by a pressure difference between the atmospheric pressure and the vacuum space 130.

However, the arch shaped recess 314 of the blocking member 310 does not concentrate the pressure on a particular portion, but distribute throughout the arch shaped recess 314, to have a reliable structural characteristic.

If the pressure is concentrated on the particular portion, the portion is liable to break to release the vacuum state.

In the meantime, even if there is a pressure applied from the inner case 110 to the vacuum space 130, or from the outer case 120 to the vacuum space 130, the supporting portion 140 between the inner case 110 and the outer case 120 may maintain a shape of the vacuum space 130.

If there is a significant temperature difference between the inside of the inner case 110 and the outside of the outer case 120, i.e., if the inside of the inner case 110 is at a refrigerating temperature of 1° C.~6° C. or a freezing temperature of −20° C.~−25° C., and an outside temperature is at a room temperature, with significant temperature gradient, active heat transfer is likely to take place.

Overall heat transfer between the inner case 110 and the outer case 120 is cut off and suppressed by the vacuum space 130.

However, since there is the sealing unit 300 connected between fronts of the inner case 110 and the outer case 120 for sealing the front of the vacuum space 130, a low flow rate of heat is transferred therethrough.

Since the filling member 320 causes the heat transfer to be made, not in a straight locus like a B direction, but in a curved locus like a C direction along the recess 314, a heat transfer path becomes longer than a case of a straight path.

If the heat transfer path becomes longer thus, to cause heat loss in middle of the heat transfer, the heat transfer is minimized and suppressed as much, enabling to prevent external heat of the outer case 120 from influencing toward the inner case 110.

The filling member 320 and the reinforcing member 330 which have heat insulating function are provided in the blocking member 310, and the front cover 170 is positioned in front of the reinforcing member 330, to prevent the filling member 320 and the reinforcing member 330 from exposing to an outside.

Configurations as described in the first and second embodiments may suppress the heat transfer between a surface of the inner case 110 and a surface of the outer case 120 which is liable to take place between the sealing unit (200 or 300) which connects the front edges of the inner case 110 and the outer case 120 to the maximum.

The arch shaped configuration of the blocking member 210 or 310 in the sealing unit 200 or 300 distributes the pressure applied to the blocking member 210 or 310 caused by the pressure difference taking place between the vacuum space 130 and the outside space, thereby preventing physical deformation from taking place.

As has been described, the refrigerator of this invention has the following advantages.

The refrigerator of this invention has, not a general insulating material, but a vacuum space formed between the inner case and the outer case for suppressing heat transfer between the inner case and the outer case.

Since a heat insulating effect of the vacuum is significantly better than a heat insulating effect of the general insulating material, the refrigerator of this invention has a heat insulating effect better than the related art refrigerator.

In the meantime, in a case of the vacuum space, the heat insulating is made available only when a vacuum state is maintained regardless of the thickness (A gap between the inner case and the outer case, in a case of the general insulating material, it is required to make a thickness of the insulating material thicker to enhance the heat insulating effect, which thickness increase increases a size of the refrigerator.

Therefore, in comparison to the related art refrigerator, since the refrigerator of this invention permits to an outside size thereof while maintaining the storage space the same, a compact refrigerator can be provided.

In the meantime, if the heat is transferred through the blocking member connected between the inner case and the outer case to block the vacuum space, a heat transfer rate can be minimized.

It will be apparent to those skilled in the art that various modifications and variations can be made in this invention without departing from the spirit or scope of the inventions. Thus, it is intended that this invention covers the modifications and variations of this invention provided they come within the scope of the appended claims and their equivalents.

What is claimed is:

1. A refrigerator comprising:

a body having a storage space, wherein the body includes;

an inner case having the storage space, an outer case having an inside surface spaced a predetermined gap from an outside surface of the inner case to house the inner case, a vacuum space provided between the inner case and the outer case and sealed to maintain a vacuum state for heat insulating between the inner case and the outer case, and a sealing unit for sealing a front of the vacuum space formed between a front of the inner case and a front of the outer case and reducing a heat transfer rate between the inner case and the outer case, wherein the sealing unit includes:

a blocking member arranged in front of the vacuum space connected between a front edge of the inner case and a front edge of the outer case to block the front of the vacuum space, the blocking member defining a curved locus of a heat transfer path between the inner case and the outer case, a filling member of an insulating material provided in front of the blocking member, the filling member being in contact with a portion of the blocking member that defines the curved locus of the heat transfer path between the inner case and the outer case and having a curved surface in conformity with the curved locus of the heat transfer path between the inner case and the outer case, a reinforcing member arranged in a space defined by the blocking member in front of the filling member for securing a position of the filling member and reinforcing strength of the sealing unit, the reinforcing member being located inside of the inner case and the outer case, extending between the inner case and the outer case, and being aligned with the front edges of the inner case and the outer case, and a front cover that connects and seals the front edges of the inner case and the outer case, the front cover completely covering the reinforcing member and the filling member and extending across the front edges of the inner case and the outer case, wherein the blocking member includes a first coupling portion coupled to and supported on the front edge of the inner case and a second coupling portion coupled to and supported on the front edge of the outer case.

2. The refrigerator as claimed in claim 1, wherein the blocking member includes;

a projection provided between the first coupling portion and the second coupling portion projected toward the vacuum space for distributing a pressure caused by a pressure gradient formed between the vacuum space and an outside space, the projection being the portion of the blocking member that defines the curved locus.

3. The refrigerator as claimed in claim 2, wherein the projection has an arch shaped cross section with a fixed thickness.

4. The refrigerator as claimed in claim 2, wherein the blocking member further includes;

a first coupling groove in the first coupling portion to couple to the front edge of the inner case, and a second coupling groove in the second coupling portion to couple to the front edge of the outer case.

5. The refrigerator as claimed in claim 2, wherein the first coupling portion is welded to the inner case, and the second coupling portion is welded to the outer case.

6. The refrigerator as claimed in claim 2, wherein the sealing unit forms the curved locus of heat transfer path between the inner case and the outer case along the projection or the recess in contact with the filling member.

7. The refrigerator as claimed in claim 1, further comprising:

a plurality of supporting portions that are each provided to contact with an outside surface of the inner case and an inside surface of the outer case to maintain a spaced state of the vacuum space; and a plurality of reinforcing ribs that are provided to the outside surface of the inner case and the inside surface of the outer case for reinforcing strength thereof, wherein the plurality of supporting portions and the plurality of reinforcing ribs are arranged spaced apart from each other such that the plurality of supporting portions and the plurality of reinforcing ribs do not overlap with each other, wherein each of the plurality of supporting portions are located entirely within the vacuum space, each of the plurality of reinforcing ribs are located entirely within the vacuum space, and each of the plurality of reinforcing ribs have a length that is less than a width of the vacuum space such that each of the plurality of reinforcing ribs contacts one of the outside surface of the inner case and the inside surface of the outer case, but does not contact the other of the outside surface of the inner case and the inside surface of the outer case, and wherein the plurality of reinforcing ribs include a first set of reinforcing ribs that contact the outside surface of the inner case, but not the inside surface of the outer case and a second set of reinforcing ribs that contact the inside surface of the outer case, but not the outside surface of the inner case.

8. A refrigerator comprising:

a body having a storage space;

a wall that is part of the body and includes an inner case and an outer case;

a vacuum space formed in the wall sealed to maintain a vacuum state for heat insulating between an outside of the body and the storage space; and a sealing unit arranged in front of the wall to seal a front of the vacuum space, wherein the sealing unit includes:

a blocking member arranged in front of the vacuum space connected between a front edge of the inner case and a front edge of the outer case to block the front of the vacuum space, the blocking member defining a curved locus of a heat transfer path between the inner case and the outer case, a filling member of an insulating material provided in front of the blocking member, the filling member being in contact with a portion of the blocking member that defines the curved locus of the heat transfer path between the inner case and the outer case and having a curved surface in conformity with the curved locus of the heat transfer path between the inner case and the outer case, a reinforcing member arranged in a space defined by the blocking member in front of the filling member for securing a position of the filling member and reinforcing strength of the sealing unit, the reinforcing member being located inside of the inner case and the outer case, extending between the inner case and the outer case, and being aligned with the front edges of the inner case and the outer case, and a front cover that connects and seals the front edges of the inner case and the outer case, the front cover completely covering the reinforcing member and the filling member and extending across the front edges of the inner case and the outer case, wherein the blocking member is thinner than the inner case and the outer case, and wherein the blocking member includes a first coupling portion coupled to and supported on the front edge of the inner case and a second coupling portion coupled to and supported on the front edge of the outer case.

9. The refrigerator as claimed in claim 8, wherein the blocking member includes;

a projection provided between the first coupling portion and the second coupling portion projected backward toward the vacuum space for distributing a pressure caused by a pressure gradient formed between the vacuum space and an outside space, wherein the projection has an arch shaped cross section with a fixed thickness and the projection is the portion of the blocking member that defines the curved locus.

10. A refrigerator comprising:

a body having a storage space, wherein the body includes:

an inner case having the storage space, an outer case having an inside surface spaced a predetermined gap from an outside surface of the inner case to house the inner case, a vacuum space provided between the inner case and the outer case and sealed to maintain a vacuum state for heat insulating between the inner case and the outer case, and a sealing unit for sealing a front of the vacuum space formed between a front of the inner case and a front of the outer case and reducing a heat transfer rate between the inner case and the outer case, wherein the sealing unit includes a blocking member arranged in front of the vacuum space connected between a front edge of the inner case and a front edge of the outer case to block the front of the vacuum space, wherein the blocking member includes:

a first coupling portion coupled to and supported on the front edge of the inner case, a second coupling portion coupled to and supported on the front edge of the outer case, and a projection toward the vacuum space between the first coupling portion and the second coupling portion, the projection having a shape of an arch for distributing a pressure and for making a curved heat transfer path between the inner case and the outer case, wherein the sealing unit also includes:

a filling member of an insulating material provided in front of the blocking member, the filling member being in contact with the projection of the blocking member that defines the curved heat transfer path between the inner case and the outer case and having a curved surface in conformity with the projection, a reinforcing member arranged in a space defined by the blocking member in front of the filling member for securing a position of the filling member and reinforcing strength of the sealing unit, the reinforcing member being located inside of the inner case and the outer case, extending between the inner case and the outer case, and being aligned with the front edges of the inner case and the outer case, and a front cover that connects and seals the front edges of the inner case and the outer case, the front cover completely covering the reinforcing member and the filling member and extending across the front edges of the inner case and the outer case.

11. The refrigerator as claim in claim 10, wherein the first coupling portion and the second coupling portion are coupled to the inner case and the outer case, respectively, with welding.

* * * * *